US009892668B2

(12) United States Patent
Wadhwa et al.

(10) Patent No.: US 9,892,668 B2
(45) Date of Patent: Feb. 13, 2018

(54) SCREEN RESIZE FOR REDUCING POWER CONSUMPTION

(71) Applicant: Avaya Inc., Basking Ridge, NJ (US)

(72) Inventors: Jitendra Singh Wadhwa, Magarpatta (IN); Ramanujan S. Kashi, Bangalore (IN)

(73) Assignee: AVAYA INC., Basking Ridge, NJ (US)

( * ) Notice: Subject to any disclaimer, the term of this patent is extended or adjusted under 35 U.S.C. 154(b) by 386 days.

(21) Appl. No.: 13/629,942

(22) Filed: Sep. 28, 2012

(65) Prior Publication Data

US 2014/0092140 A1 Apr. 3, 2014

(51) Int. Cl.
*G09G 5/00* (2006.01)
*G09G 3/20* (2006.01)

(52) U.S. Cl.
CPC ..... *G09G 3/20* (2013.01); *G09G 2310/0232* (2013.01); *G09G 2310/04* (2013.01); *G09G 2320/0686* (2013.01); *G09G 2330/021* (2013.01); *G09G 2340/045* (2013.01)

(58) Field of Classification Search
CPC ..... G06T 3/40; G06F 1/3287
USPC ..... 345/660
See application file for complete search history.

(56) References Cited

U.S. PATENT DOCUMENTS

| | | | | |
|---|---|---|---|---|
| 5,822,599 | A * | 10/1998 | Kidder et al. | 713/324 |
| 6,624,816 | B1 * | 9/2003 | Jones, Jr. | 345/503 |
| 6,701,263 | B2 * | 3/2004 | Jeong | 702/60 |
| 7,629,971 | B2 * | 12/2009 | Plut | 345/211 |
| 8,259,232 | B2 * | 9/2012 | Iino | 348/564 |
| 2003/0156074 | A1 * | 8/2003 | Ranganathan et al. | 345/1.1 |
| 2006/0132474 | A1 * | 6/2006 | Lam | 345/204 |
| 2007/0226522 | A1 * | 9/2007 | Aleksic | G06F 1/3203 713/300 |
| 2009/0058842 | A1 * | 3/2009 | Bull et al. | 345/212 |

* cited by examiner

*Primary Examiner* — M Good Johnson

(57) ABSTRACT

Embodiments disclosed herein provide systems, methods, and software for dynamically managing power consumption of a device capable of operating on battery power, or other power. In particular, the size of the viewable area of the display may be dynamically controlled to reduce the number of activated pixels to reduce power consumption. The resizing of the viewable area of a screen may also reduce the number of applications running, thereby reducing power consumption. An indication of the amount of operation time, battery indicator, and/or energy left in the battery may be presented, based at least in part on the dynamic resize of the display.

20 Claims, 4 Drawing Sheets

SCREEN RESIZE FOR REDUCING POWER CONSUMPTION

TECHNICAL BACKGROUND

Portable electronic devices, such as smartphones and tablets, are becoming very prevalent. Most of these devices include displays for presenting visual information, such as a graphical user interface and media content. Some displays are also touchscreens capable of receiving user input. A user may operate a device to view media, browse the Internet, check email, exchange messages, and execute applications.

Many of these devices are battery powered and are, therefore, limited to the amount of power stored in the batteries to operate. While processing circuitry in the device uses some of the power to operate the device, the displays for these devices also use a large portion of the power when in operation. Typically, a user can lower the brightness of the display in order to use less battery power. Even though lowering the brightness of a display can extend the battery life of an electronic device, lowering the brightness may not extend the battery life as long as a user desires.

Overview

Embodiments disclosed herein provide systems, methods, and software for dynamically managing power consumption of a device with a display. In particular, the size of the viewable area of the display may be dynamically controlled and portions of the display may be deactivated to reduce power consumption. The resizing of the viewable area of a screen may also reduce the number of applications running, thereby reducing power consumption. An indication of the amount of operation time, battery indicator, and/or energy left in the battery may be presented based at least in part on the dynamic resize of the display.

DETAILED DESCRIPTION

The following description and associated figures teach the best mode of the invention. For the purpose of teaching inventive principles, some conventional aspects of the best mode may be simplified or omitted. The following claims specify the scope of the invention. Note that some aspects of the best mode may not fall within the scope of the invention as specified by the claims. Thus, those skilled in the art will appreciate variations from the best mode that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
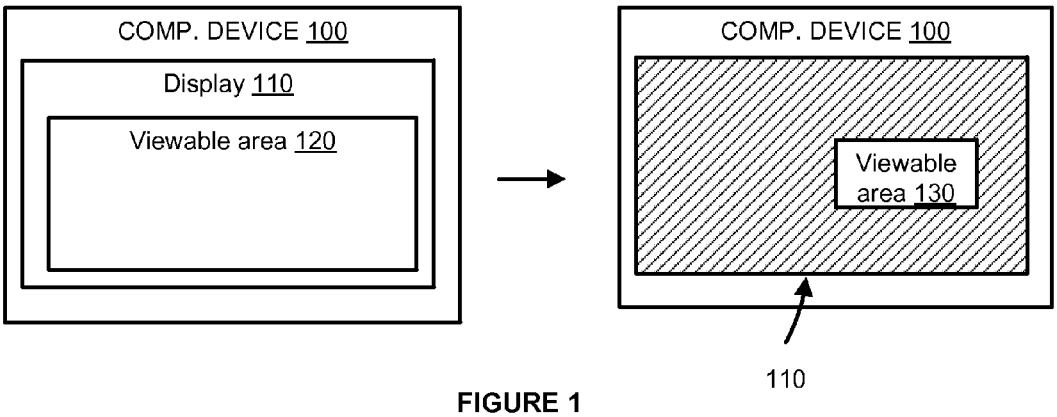
FIG. 1 illustrates a user interface display according to an example.

FIG. 1 illustrates computing device 100. Computing device 100 includes hardware processing circuitry for executing software instructions and memory for storing those software instructions. Computing device 100 may further include a display 110, speaker, microphone, buttons, keyboard, network adaptor, wireless communication radio, GPS receiver, accelerometer, or any other hardware-computing element—including combinations thereof. Computing device 100 may be a telephone, personal computer, laptop, e-book reader, mobile Internet appliance, wireless network interface card, media player, game console, or some other computing apparatus—including combinations thereof.

Display 110 may include a viewable area 120, which may include the entire display, or some portion of the display 110. Viewable area 120 may include visual icons of applications, pictures, menus, or other depictions.

As shown, the viewable area may change to a different size viewable area 130. The remainder of display 110 may be blank, black, and/or not energized, engaged, or off. By reducing the viewable area and not using the remainder of display 110, the power consumption of computing device 100 may be reduced.

If computing device 100 is using battery power, the battery life may increase in response to the viewable area of the display being reduced. It will be appreciated that although a computing device is shown, the device with display 110 may be only a display, such as a portable DVD player screen or other device, which may not include a processor.

Figure 2:
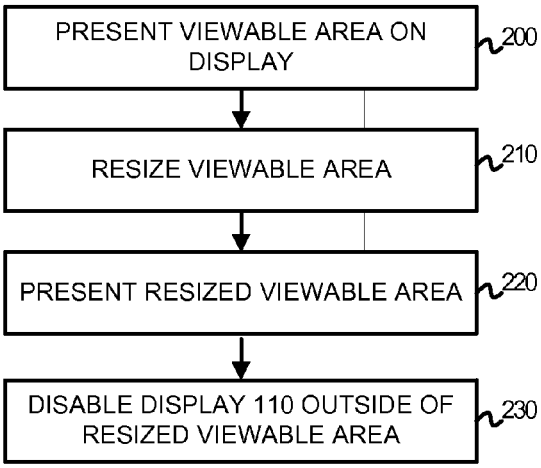
FIG. 2 illustrates a method of operation of the computing device.

FIG. 2 illustrates the operation of computing device 100 in resizing the viewable area 120 to conserve power. Computing device 100 presents a first viewable area 120 on display 110 (step 200). Display 110 may be a liquid crystal display (LCD), light emitting diode (LED), organic LED (OLED), plasma, or some other type of display technology. Viewable area 120 may include the entire display 110 or a portion of the display 110. Viewable area 120 may display a graphical user interface for computing device 100, media playback, application information, or any other type of displayable information, including combinations thereof.

Next, computing device 100 resizes first viewable area 120 (step 210). Computing device 100 may resize first viewable area 120 in response to a user input indicating parameters to which the display should be resized. The user input may include indicating a desired viewable area size on a touch screen using a user's fingers or a stylus, entering viewable area parameters into a hardware or software keyboard, receiving parameters over a communication network, using preinstalled parameters, or any other method of receiving parameters into a computing device. In a particular example, a user may pinch first viewable area 120 to the desired viewable area size and/or location on display 110.

In some embodiments, computing device 100 may resize first viewable area 120 automatically upon a trigger condition. For example, a battery life trigger may be set in computing device 100 that triggers computing device 100 to resize first viewable area 120 at a threshold level of battery life. The viewable area may be resized to parameters already stored in computing device 100 that were previously received from a user or elsewhere, or computing device 100 may prompt a user for resizing parameters upon activation of the trigger.

Thereafter, computing device 100 presents the resized second viewable area 130 (step 220). Second viewable area 130 is typically smaller than the first viewable area 120. When the viewable area is resized 220, size and location of the second viewable area 130 may be determined either from a received user input or as suggested by computing device 100. In some embodiments, the display information being presented in first viewable area 120 may be scaled to fit in second viewable area 130. Alternatively, the display information for applications in use on computing device 100 may be reformatted to more effectively display application information in second viewable area 130. For example, one or more displayed applications may display less functionality in order to fit into second viewable area 130. The displayed applications and their functionalities may be selected by a user or determined by computing device 100. Execution of other applications may be terminated either automatically by computing device 100 or at the request of a user.

In another alternative, second viewable area 130 may display a portion of first viewable area 120. Second viewable area 130 may then be moved around display 110 by a user in order for the user to view other portions of viewable area 120. In further embodiments, first viewable area 120 may display a larger format version of an application, such as a tablet computer version, and then second viewable area 130 may display a smaller format version of the same application, such as a smartphone version. In those embodiments, the size of viewable areas 120 and 130 may be determined based on resolution requirements of the two different application formats.

In yet another example, computing device 100 may display selected applications in second viewable area 130. Before or after providing parameters for second viewable area 130, the user may select one or more applications from a list of applications available/installed computing device 100. A user may use various methods to select the one or more applications. For example, the application selection may be performed by selecting applications from a list, checking a check box associated with each application, long pressing an application and then drag and drop the selected application in second viewable area 130, or any other way that a user can indicate a selection on a computing device. In some cases, the user may predefine a set of applications that should be used when computing device 100 is operating with a reduced viewable area. Once the applications are selected, computing device 100 automatically force closes, switches off, or otherwise ends execution of any unselected applications. The selected applications are then viewed in the second viewable area 130.

In a specific example, a user first selects second viewable area 130 and then selects essential applications like a dial/number pad application, a messaging application, and date/time application to be active and displayed in second viewable area 130. All other applications, such as email, GPS, WiFi, or Data Packets exchanges, are then force closed or prevented from further executing on computing device 100. Reducing the number of executing applications reduces the processing power required to execute those applications thereby further enhancing the remaining battery life of computing device 100.

After presenting second viewable area 130, computer device 100 deactivates the area of display 110 outside of second viewable area 130 (step 230). The method used to deactivate the area of display 110 may vary depending on the display technology 110. For example, an OLED may be able to turn off pixels in the area outside of second viewable area 130. Likewise, an LCD may turn off pixels in the area outside of second viewable area 130 and adjust the backlight of the LCD so that the backlight does not use power to illuminate disabled pixels. Deactivating pixels in display 110 allows display 110 to use less power than would be used if those pixels were functioning.

In some embodiments, a power level indication, such as battery life remaining, is indicated based at least in part on the second resized viewable area 130 and/or running applications on the device 100. The power level indication may be displayed anywhere in a viewable area of display 110 or on an alternative display element of computing device 100, such as a dedicated battery life LED. The power level indication may be provided after second viewable area 130 is displayed. Alternatively, the power indication may be displayed and adjusted as a user indicates parameters to resize first viewable area 120. This allows a user to adjust the parameters for second viewable area 130 until the user is satisfied with the power level indication. For example, computing device 100 may display that battery life remaining is 15 minutes but a user needs 45 minutes worth of battery life to complete a task. The user may then enter resize parameters until the battery life is indicated as 45 minutes. Computing device 100 then displays second viewable area 130 based on those parameters.

This system and method reduces user input to close the running applications in order to save battery drainage and thus increase efficiency of the system. This system and method also provides the user to select multiple screen sizes and set a screen size based on the user desired power savings and/or remaining battery life. It should be understood that the above method can apply to any type of device that is able to resize a viewable area of a display. Thus, while many of the embodiments below pertain to wireless communication devices, such as smartphones, the method also applies to desktop computers, gaming systems, and other display devices.

Figure 3:
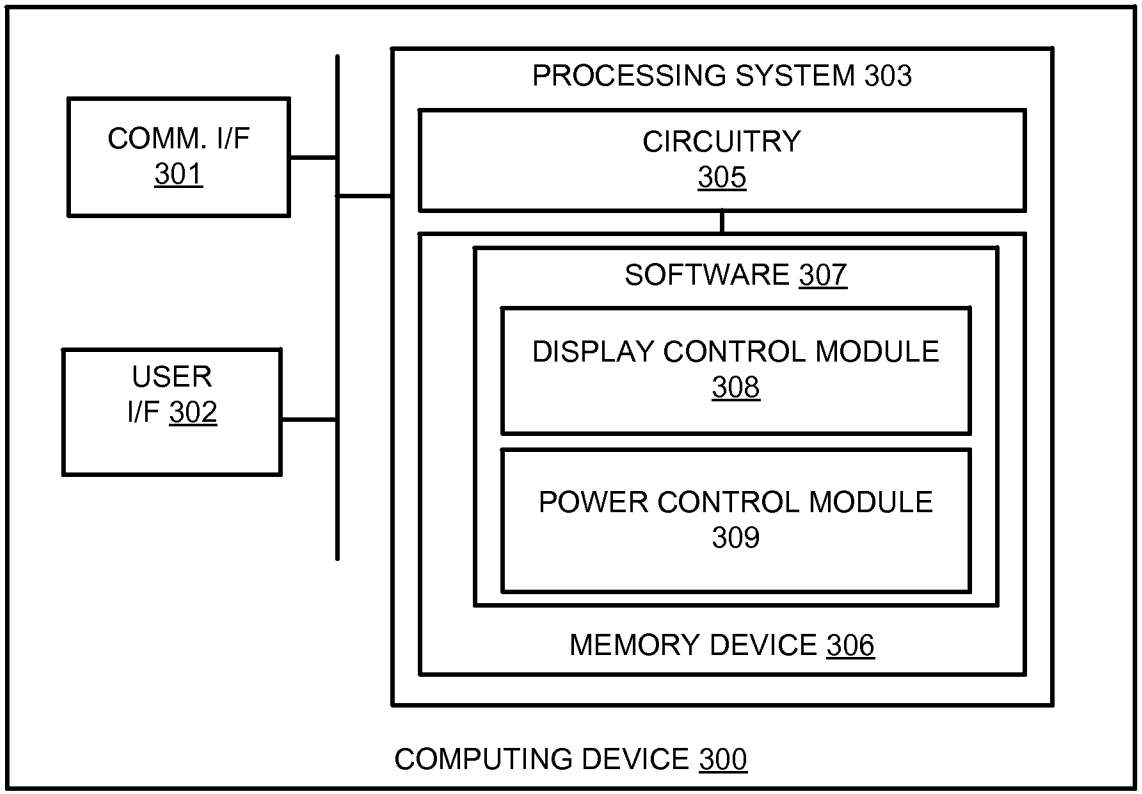
FIG. 3 illustrates a computing device according to an example.

FIG. 3 illustrates computing device 300. Computing device 300 is an example of computing device 100 or wireless devices, portable devices, and/or display devices, and/or combinations thereof, although alternative configurations are also included. Computing device 300 comprises communication interface 301, user interface 302, and processing system 303. Processing system 303 is linked to communication interface 301 and user interface 302. Processing system 303 includes processing circuitry 305 and memory device 306 that stores operating software 307. Computing device 300 may include other well-known components such as a battery and enclosure that are not shown for clarity. Computing device 300 may be a telephone, computer, e-book reader, mobile Internet appliance, media player, game console, wireless network interface card, or some other device with a display, including combinations thereof.

Communication interface 301 comprises components that communicate over communication links, such as network cards, ports, RF transceivers, processing circuitry and software, or some other communication devices. Communication interface 301 may be configured to communicate over metallic, wireless, or optical links. Communication interface 301 may be configured to use TDM, IP, Ethernet, optical networking, wireless protocols, communication signaling, or some other communication format, including combinations thereof.

User interface 302 comprises components that interact with a user to receive user inputs and to present media and/or information. User interface 302 may include a speaker, microphone, buttons, lights, display screen, touch screen, touch pad, scroll wheel, communication port, or some other user input/output apparatus, including combinations thereof. User interface 302 may be omitted in some examples.

Processing circuitry 305 comprises microprocessor and other circuitry that retrieves and executes operating software 307 from memory device 306. Memory device 306 comprises a non-transitory storage medium, such as a disk drive, flash drive, data storage circuitry, or some other memory apparatus. Processing circuitry 305 is typically mounted on a circuit board that may also hold memory device 306 and portions of communication interface 301 and user interface 302. Operating software 307 comprises computer programs, firmware, or some other form of machine-readable processing instructions.

Operating software 307 includes display control module 308 and power control module 309. Operating software 307 may further include an operating system, utilities, drivers, network interfaces, applications, or some other type of software. When executed by processing circuitry 305, operating software 307 directs processing system 303 to operate computing device 300 as described herein.

In particular, display control module 308 directs processing system 303 to receive a condition, the occurrence of which indicates the viewable area on a display on computing device 300 has been resized and power control module 309 should indicate a change in power/battery life based on the change.

Display control module 308 may be part of the operating system of computing device 300, the application installed on computing device 300, a different application on computing device 300, or some other independent software component. Though shown separately, power control module 309 may be incorporated into display control module 308.

Figure 4:
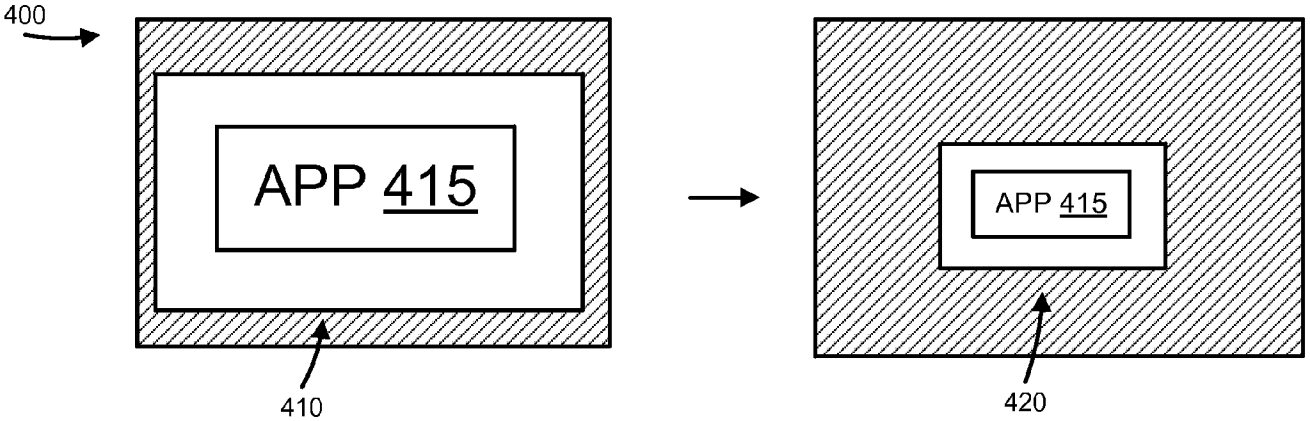
FIG. 4 illustrates a user interface display resize according to an example.

FIG. 4 is an illustration of a display resize according to an example. Display 400 may have a first viewable area 410. Display 400 may also show an application 415 which is entirely viewable within first viewable area 410, and can be currently executing on the device.

The viewable area may be resized to a smaller, second viewable area 420. One method of achieving the resize may include resizing the viewable area such that the application 415 is still viewable and running, but maybe smaller than in first viewable area 410. In this example, everything viewable within first viewable area 410 may also be viewable within second viewable area 420.

The energy saving in this example may be only from the reduced area of display 400 which may not be illuminated or energized. Other methods may also be employable, such as the example in FIG. 5.

Figure 5:
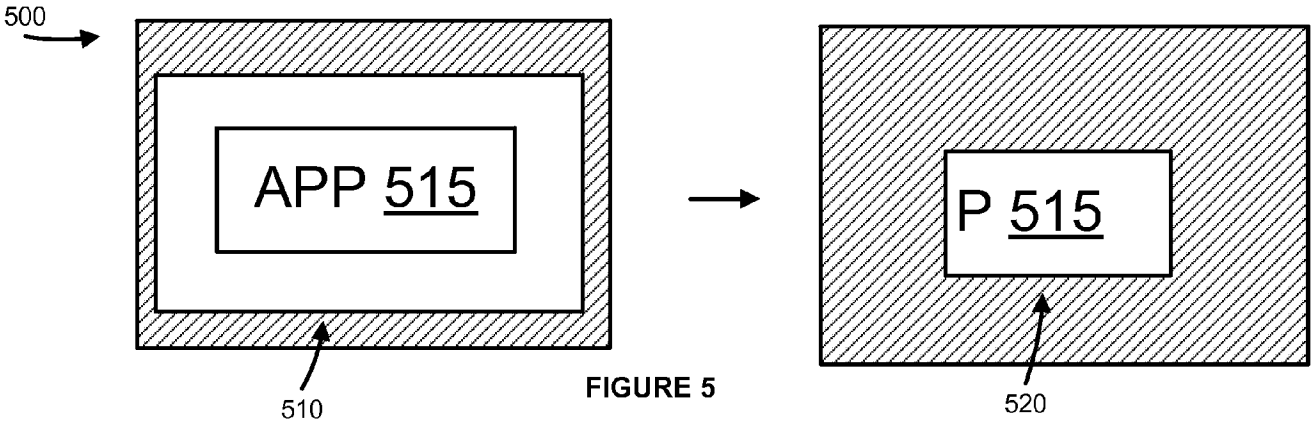
FIG. 5 illustrates a user interface display resize according to an example.

FIG. 5 is an illustration of another method of resizing a display according to another example. In this example display 500 may include a first viewable area 510, which shows an icon for an application 515. When the viewable area is resized to a second viewable area 520, only a portion of the application icon 515 may be viewable.

Other applications that are not now visible within the second viewable area 520 may also be turned off or otherwise shutdown to further save power. In this example, power may be saved by shutting down previously viewable and running applications, and by powering only a portion of the display 500. The status of the applications may be changed to indicate they should be deactivated or any other change to the applications' status. This may be included in the resizing of the viewable area.

In this example only viewable applications in the second viewable area may remain running. In this example, the user may select the screen size and the application to remain running on the device. This may save the user time and make it easier for the user to save power on the device.

Figure 6:
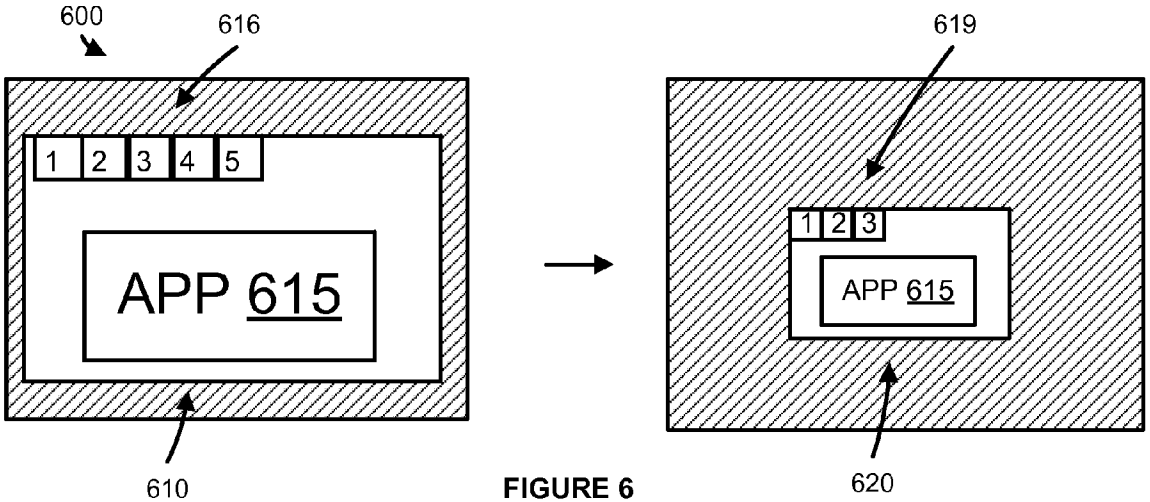
FIG. 6 illustrates a user interface changing to a mobile view according to an example.

FIG. 6 illustrates another example in which a display 600 may be resized to save power. Display 600 may include a first viewable area 610, which may be a viewable area and display configured generally for a tablet computer. Within viewable area 610 may be an application icon 615 and a menu bar 616. In this example menu bar 616 includes 5 menu choices.

When the viewable area 610 is resized, the second viewable area 620 may be generally configured for a mobile telephone or other device with a generally smaller display area. As shown, the icon for application 615 may be resized smaller, and menu bar 619 only includes 3 menu choices instead of 5.

The second viewable area will include menus, applications, and other characteristics of a device with a generally smaller display. This may be one manner in which power is conserved, along with reducing the amount of display used and/or powered. This may also reduce the number of applications running on the device.

Figure 7:
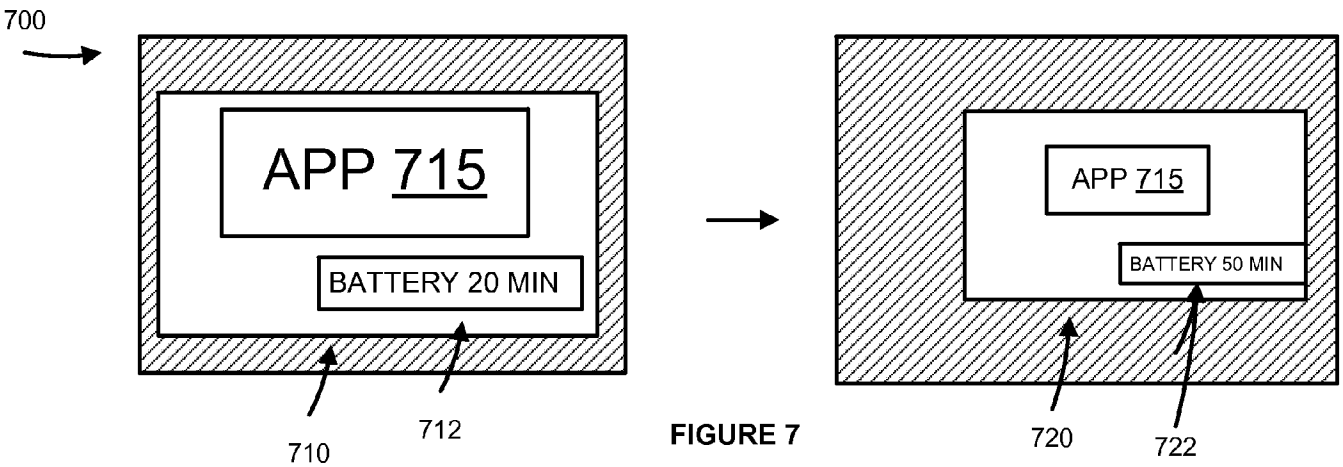
FIG. 7 illustrates a user interface with battery life indication according to an example.

FIG. 7 shows another example of a method for resizing a display, according to an example. Display 700 includes a first viewable area 710. Viewable within first viewable area 710 may be an application 715, and a power, and/or battery life indicator 712. Battery life indicator 712 may indicate time remaining of battery life based at least in part on the first viewable area 710 being energized, powered, activated, and/or viewable. In this example, battery life indicator 712 indicates 20 minutes of battery life remaining.

The viewable area may be resized to a second viewable area 720. As shown, application 715 may still be viewable within second viewable area 720, as well as a battery life indicator 722. Once resized, battery life indicator 720 may indicate that a greater amount of battery life time is remaining based at least in part on the second viewable area, and any application(s), menus, or other items being shut down. In this example, battery life indicator 720 indicates that there are now 50 minutes of battery life remaining.

With this system and method, a user may be able to use the battery life indicator to decide how much to resize the viewable area to achieve a percentage of battery remaining, or a time until the battery will no longer be able to power the display 700. This may provide the user with indications of the battery life change based on the display resize. This provides the user with flexibility in that the user may choose the display size wanted, or the battery life remaining, to achieve the desired result.

There are many methods for resizing a display and conserving power. These examples are only a few of the many ways to achieve these results. All methods and system for resizing a display and conserving power are intended to be encompassed by this disclosure.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. As a result, the invention is not limited to the specific embodiments described above, but only by the following claims and their equivalents.

What is claimed is:

1. A non-transitory computer readable medium having instructions stored thereon for operating a computing device, wherein the instructions, when executed by the computing device, direct the computing device to:

present a first viewable area on a display of the computing device;

receive parameters for resizing the first viewable area;

resize the first viewable area to a second viewable area on the display based on the parameters;

resize a display image of the first viewable area to fit within the second viewable area;

disable portions of the display not included in the second viewable area; and end execution of applications not displayed in the second viewable area.

2. The non-transitory computer readable medium of claim 1, wherein the instructions further direct the computing device to indicate a battery life for the device based at least in part on the disabled portions of the display.

3. The non-transitory computer readable medium of claim 1, wherein, to resize the display image, the instructions further direct the computing device to scale the display image of the first viewable area to fit the second viewable area.

4. The non-transitory computer readable medium of claim 1, wherein the instructions further direct the computing device to present the second viewable area on the display of the computing device.

5. The non-transitory computer readable medium of claim 1, wherein the instructions further direct the computing device to receive the parameters via a user input indicating the size and location of the second viewable area on the display.

6. The non-transitory computer readable medium of claim 5, wherein the instructions further direct the computing device to receive a user input indicating an applications status to be modified.

7. The non-transitory computer readable medium of claim 6, wherein the instructions further direct the computing device to indicate a battery life remaining based at least in part on the modified applications status.

8. The non-transitory computer readable medium of claim 1, wherein the instructions directing the computing device to resize the first viewable area comprise instructions directing the computer to resize the second viewable area to generally the viewable area of a display smaller than the display of the computing device.

9. The non-transitory computer readable medium of claim 1, wherein the instructions directing the computing device to resize the first viewable area comprise instructions directing the computer to modify display characteristics of an application within the second viewable area.

10. A method of operating a computing device, comprising:

presenting a first viewable area on a display of the computing device;

receiving parameters for resizing the first viewable area;

resizing the first viewable area to a second viewable area on the display based on the parameters;

resizing a display image of the first viewable area to fit within the second viewable area;

disabling portions of the display not included in the second viewable area; and end execution of applications not displayed in the second viewable area.

11. The method of claim 10, further comprising indicating a battery life for the device based at least in part on the disabled portions of the display.

12. The method of claim 10, wherein resizing the display image comprises scaling the display image of the first viewable area to fit the second viewable area.

13. The method of claim 10, further comprising presenting the second viewable area on the display of the computing device.

14. The method of claim 10, further comprising receiving the parameters via a user input indicating the size and location of the second viewable area on the display.

15. The method of claim 14, further comprising receiving a user input indicating an applications status to be modified.

16. The method of claim 15, further comprising indicating a battery life remaining based at least in part on the modified applications status and the size and location of the second viewable area.

17. The method of claim 10, wherein resizing the viewable area comprises resizing the second viewable area to generally the viewable area and functionality of a display smaller than the display of the computing device.

18. The method of claim 10, wherein resizing the viewable area comprises modifying display characteristics of an application within the second viewable area.

19. A computing device, comprising:

a display configured to display a first viewable area and a second viewable area; and a processor configured to present the first viewable area on the display, receive parameters for resizing the first viewable area, resize the first viewable area to the second viewable area on the display based on the parameters, resize a display image of the first viewable area to fit within the second viewable area, disable portions of the display not included in the second viewable area, and end execution of applications not displayed in the second viewable area.

20. The computing device of claim 19, wherein the processor is further configured to indicate a battery life for the device based at least in part on the disabled portions of the display.

* * * * *